US007336919B2

(12) United States Patent
Beach et al.

(10) Patent No.: US 7,336,919 B2
(45) **Date of Patent: *Feb. 26, 2008**

(54) MULTILAYER FUSER MEMBER INCLUDING CURRENT ELEMENTS

(75) Inventors: Bradley L. Beach, Lexington, KY (US); Ronald L. Roe, Lexington, KY (US); Jerry W. Smith, Irvine, KY (US)

(73) Assignee: Lexmark International, Inc., Lexington, KY (US)

( * ) Notice: Subject to any disclaimer, the term of this patent is extended or adjusted under 35 U.S.C. 154(b) by 56 days.

This patent is subject to a terminal disclaimer.

(21) Appl. No.: 11/154,176

(22) Filed: Jun. 16, 2005

(65) Prior Publication Data

US 2006/0285894 A1 Dec. 21, 2006

(51) Int. Cl.
*G03G 15/20* (2006.01)

(52) U.S. Cl. ..... 399/333; 399/330

(58) Field of Classification Search ..... 399/333, 399/330

See application file for complete search history.

(56) References Cited

U.S. PATENT DOCUMENTS 4,395,109 A * 7/1983 Nakajima et al. ..... 399/338
5,084,738 A 1/1992 Ishikawa
5,087,946 A 2/1992 Dalal et al.
5,115,279 A 5/1992 Nishikawa et al.
5,319,427 A * 6/1994 Sakurai et al. ..... 399/333
5,436,712 A 7/1995 Wayman et al.
5,530,534 A 6/1996 Dalal
5,614,935 A * 3/1997 Ogi et al. ..... 347/213
5,708,950 A 1/1998 Badesha et al.
5,837,340 A 11/1998 Law et al.
5,907,348 A 5/1999 Ogasawara et al.
5,978,641 A 11/1999 Wayman et al.
6,063,463 A 5/2000 Schlueter, Jr. et al.
6,122,479 A 9/2000 Fujita et al.
6,122,480 A 9/2000 Hwang
6,127,654 A 10/2000 Fletcher
6,201,945 B1 3/2001 Schlueter, Jr. et al.
6,223,017 B1 * 4/2001 Akutsu et al. ..... 399/330
6,246,035 B1 6/2001 Okuda
6,289,198 B1 9/2001 Kawamura et al.
6,393,247 B1 * 5/2002 Chen et al. ..... 399/330
6,611,670 B2 8/2003 Chen et al.

(Continued)

OTHER PUBLICATIONS

Pennington et al.; Resistive Ribbon Thermal Transfer Printing: A Historical Review And Introduction To A New Printing Technology; IBM J. Res. Develop.; Sep. 1985; pp. 449-458; vol. 29, No. 5; International Business Machines Company.

*Primary Examiner*—David M. Gray
*Assistant Examiner*—Ryan D. Walsh
(74) *Attorney, Agent, or Firm*—Dinsmore & Shohl, LLP

(57) ABSTRACT

A fuser member adapted to fuse toner onto the surface of a recording medium as the recording medium passes a nip area of the fuser member comprises a electrically conductive polymer layer, a resistive layer, an electrically conductive layer, a primer layer, and a release layer. The fuser member further comprises a current supply element and a current return element, wherein the current supply element and the current return element are configured to provide current flow through the electrically conductive polymer layer and the resistive layer to generate fusing heat at the nip area.

24 Claims, 3 Drawing Sheets

U.S. PATENT DOCUMENTS

| | | | | |
|---|---|---|---|---|
| 6,689,528 | B2 | 2/2004 | Ream et al. | |
| 7,092,659 | B2 * | 8/2006 | Brenner | 399/170 |
| 2003/0147680 | A1 | 8/2003 | Kawamura et al. | |
| 2003/0190470 | A1 | 10/2003 | Ream et al. | |
| 2004/0096765 | A1 | 5/2004 | Miyakawa | |

* cited by examiner

MULTILAYER FUSER MEMBER INCLUDING CURRENT ELEMENTS

FIELD OF THE INVENTION

This invention relates to a fusing member suitable in electrophotography for fusing toner on a recording medium, and particularly to a multilayer fuser member employing localized Joule heating wherein fusing heat is generated near the surface of the fusing member at a nip area.

BACKGROUND OF THE INVENTION

In electrophotography, the fusing process for fixing toner on a recording medium may be conducted in many ways. The fusing process may be conducted utilizing radiant fuser members, such as infrared (IR) lamp heating members, to heat the toner and fuse the toner to a recording medium, such as paper, without contacting the recording medium with the heating member. Other fusing processes utilize hot roll fuser members, which typically comprise a metal core roll provided with various surface coatings. The metal core is heated typically with a lamp positioned inside of the core roll, and heat diffuses outward towards the surface of the fuser member.

Alternative fuser members may comprise belt fusers. A belt fuser typically comprises a polymeric belt with various coatings as the fusing member, wherein the belt is typically heated with a lamp or a ceramic heater, and the heat is transferred to the fusing belt by contact. These fusers typically have a faster warm up time from a cold start as compared with hot roll fuser members.

Furthermore, fusing may occur though induction heating. Induction heating fuser members typically comprise a substrate coated with a metal layer, and release or elastomeric layers. The metal layer is heated through an induction heating process. Induction fusing members may be comprised of a roll or a belt.

Joule heating has also been utilized in fusing processes in electrophotography. Joule heating occurs when an electrical current flows through a resistive material wherein the material's electrical resistivity to current flow generates heat. The Hwang U.S. Pat. No. 6,122,480 discloses a fuser member wherein the core of the fuser member is heated using Joule heating, and the heat diffuses outward from the core towards the surface of the fuser member.

The Ogasawara U.S. Pat. No. 5,907,348 and the Chen U.S. Pat. No. 6,393,247 disclose fuser members comprising a metal resistive layer, preferably nickel or aluminum, wherein Joule heating occurs in the metal resistive layer. The Chen U.S. Pat. No. 6,611,670 discloses an external Joule heating member to provide heat to a fuser member by contact.

As additional electrophotography devices of varying size, capability, and cost are developed, the need arises for improvements in components thereof, including fuser members.

SUMMARY OF THE INVENTION

According to the present invention, a fuser member comprising a electrically conductive polymer layer, a resistive layer, an electrically conductive layer, a primer layer, and a release layer is provided. The fuser member further comprises a current supply element and a current return element, wherein the current supply element and the current return element are configured to provide current flow through the electrically conductive polymer layer and the resistive layer to generate fusing heat at the nip area. The fuser member uses the fusing heat to fuse toner onto the surface of a recording medium as the recording medium passes a nip area of the fuser member.

In accordance with another embodiment of the present invention, a fuser member comprising a electrically conductive polymer layer, a resistive layer, an electrically conductive layer, a primer layer, and a release layer is provided. The fuser member includes a current supply roll and a current return roll, which are configured to provide current flow through the electrically conductive polymer layer and the resistive layer to generate fusing heat at the nip area. The fuser member uses the fusing heat to fuse toner onto the surface of a recording medium as the recording medium passes a nip area of the fuser member.

The fuser members of the invention are advantageous in providing efficient and fast heating for fusing toner to a recording medium. These and additional objects and advantages provided by the fuser member of the present invention will be more fully understood in view of the following detailed description.

BRIEF DESCRIPTION OF THE DRAWINGS

The following detailed description of specific embodiments of the present invention can be best understood when read in conjunction with the following drawings, where like structure is indicated with like reference numerals and in which.

DETAILED DESCRIPTION

The present invention relates to a fuser member, which utilizes Joule heating to fix toner on the surface of a recording medium. The fuser member, which may be comprised of a belt or a roll, includes a electrically conductive polymer layer, a resistive layer, an electrically conductive layer, a current supply element, and a current return element. In one embodiment, the electrically conductive polymer layer 22, the resistive layer 24, and the electrically conductive layer 26 are arranged sequentially with the electrically conductive polymer layer 22 being the innermost of the three layers. The fuser member may also comprise a primer layer, and a release layer. The current supply element and current return element are operable to provide electric current to the fuser member, wherein the current then flows through the electrically conductive polymer layer and the adjacent resistive layer to generate fusing heat. Subsequently, the current flow into the electrically conductive layer, which delivers the current back to the current return element. When a recording medium, such as paper, passes the fusing nip area, the toner is fused to the recording medium by the fusing heat generated in the electrically conductive polymer layer and the resistive layer. Furthermore, the present invention also relates to a fuser unit comprising such a fuser member in combination with a backup roll to create a fusing nip. The backup roll may be positioned to provide pressure on the recording medium at the fusing nip.

Figure 1:
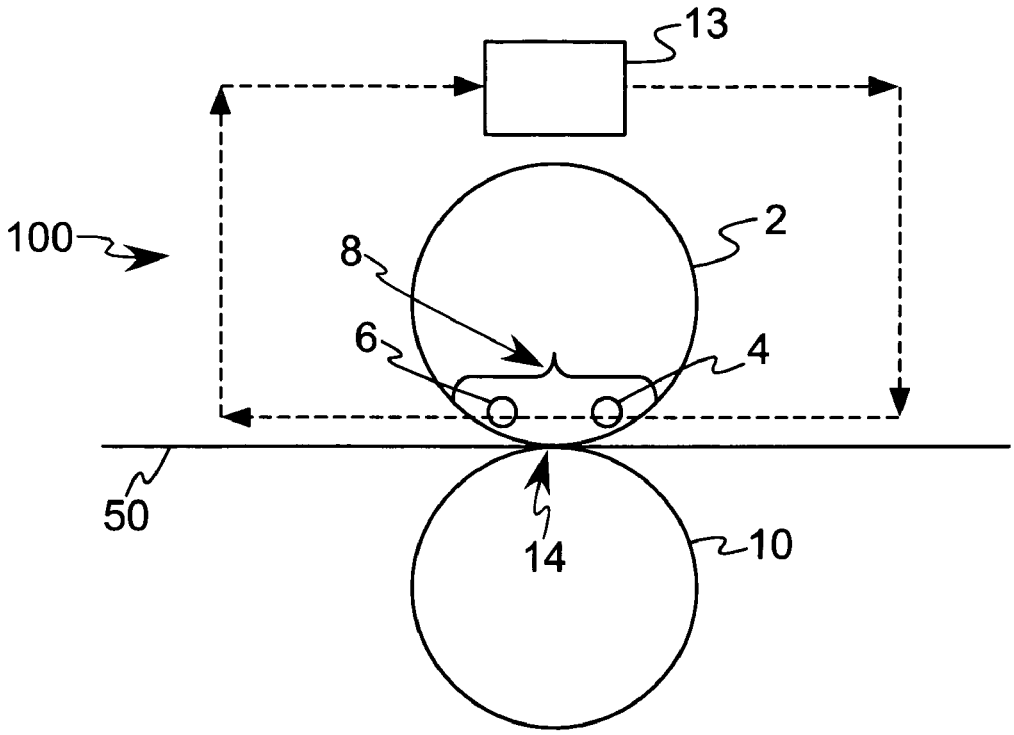
FIG. 1 is a schematic view of one embodiment of a fuser unit comprising a fuser member and backup roll according to the present invention.
Figure 2:
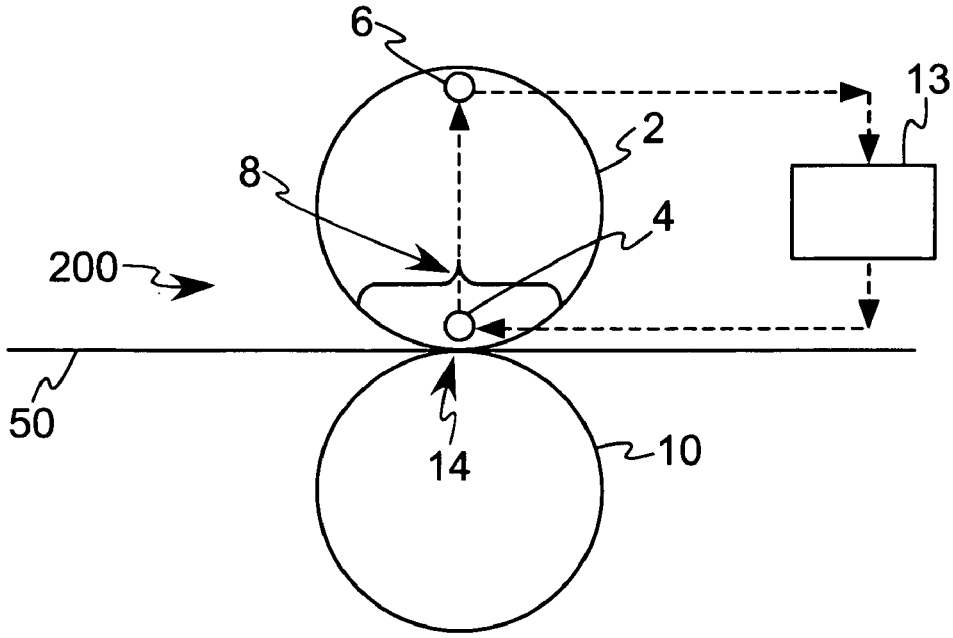
FIG. 2 is a schematic view of another embodiment of a fuser unit comprising a fuser member and backup roll according to the present invention.

Referring to FIGS. 1 and 2, two embodiments of a fuser member 2 according to the invention are demonstrated. The fuser unit 100 (FIG. 1) or 200 (FIG. 2) includes a fuser member 2 and a backup roll 10. The fuser member 2 and the backup roll 10 are positioned to form a nip 14 between them, through which a recording medium 50 will travel for fusing of toner on a surface of the recording medium 50. In addition to providing fusing heat, the fuser member 2 and the backup roll 10 may be closely positioned so as to apply pressure to the recording medium 50, to assist in fixing toner on the recording medium 50 surface. In one embodiment, the backup roll 10 is comprised of a sleeved silicon foam roll configured to contact the fuser member 2 at the fusing nip 14 and apply pressure to the recording medium 50. One of ordinary skill in the art will appreciate however that other backup roll 10 materials and/or configurations may also be employed in the fuser units of the invention.

The fuser member 2 comprises a current supply element 4 and a current return element 6 operable to provide current through the electrically conductive polymer layer 22 and the resistive layer 24 to generate fusing heat at a fusing nip area 8. The fusing nip area 8 is that area of the fuser member 2 positioned adjacent the nip 14 and therefore adjacent a recording medium 50 traveling past the fuser member 2 for fixing of toner. An electric current is passed through the fuser member 2, at least at the fusing nip area 8 adjacent the nip 14 that is formed between the fusing member 2 and the backup roll 10. The current supply element 4 and current return element 6 provide a current path from a power source 13 through the fusing member 2 and back to the power source 13. The current supply element 4 and current return element 6 are spaced to ensure the current flows through the fusing nip area 8, in order to generate heat where the fusing occurs.

Figure 6:
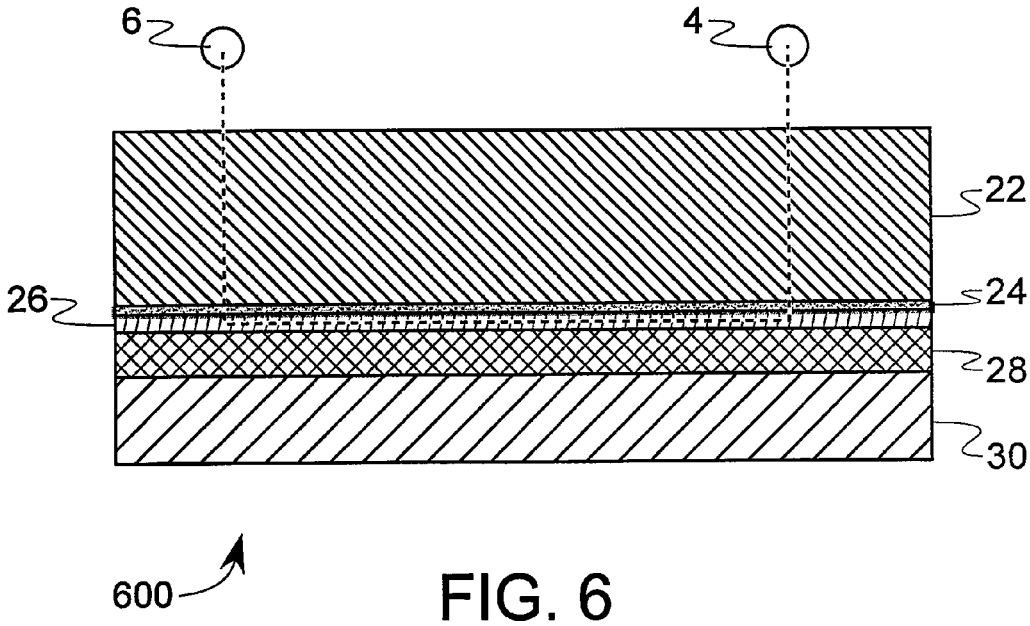
FIG. 6 is a cross-sectional view illustrating current flow though a multilayer embodiment of a fuser member according to one or more embodiments of the present invention.

FIG. 6 illustrates the flow of current though a multilayer fuser member 600 in accordance with the present invention. The current flows through the electrically conductive polymer layer 22 and the resistive layer 24 and into the electrically conductive layer 26. The electrically conductive layer 26 then carries most of the current to the current return element 6. Heat is primarily generated at the interface of the current supply element 4 and the electrically conductive polymer layer 22, at the interface of the current return element 6 and the electrically conductive polymer layer 22, within the electrically conductive polymer layer 22, at the interface of the electrically conductive polymer layer 22 and the resistive layer 24, at the resistive layer 24, and at the interface of the resistive layer 24 and electrically conductive layer 26 interface. In one fuser member embodiment, the majority of fusing heat is generated at the resistive layer 24 interfaces. This is advantageous, because it ensures the heat is generated adjacent to the nip area 8 of the fusing surface.

The supply element 4 and the return element 6 are typically comprised of electrodes in the form of rolls. The supply element 4 and the return element 6 may include a wide range of components. It is preferable that these components are electrically conductive, thermally insulating, resistant to temperatures greater than 180° C., and have a low thermal mass.

FIGS. 1 and 2 demonstrate two configurations for placement of the current supply element 4 and the current return element 6. There are many additional possible placement configurations for the supply element 4 and the return element 6. The current supply element 4 is located near the fusing nip in each embodiment to provide localized Joule heating close to the fusing nip area 8. However, as illustrated by FIG. 1 and FIG. 2, the distance between the current supply element 4 and the current return element 6 may vary, thus many suitable configurations are possible. In the embodiment of FIG. 1, wherein the current supply element 4 and the current return element 6 are both adjacent the nip area 8, the heating is substantially localized to the nip area 8. The embodiment in FIG. 2 extends the current path so that a higher percentage of the current is forced into the electrically conductive layer 26, which improves the efficiency of localized heating at the resistive layer 24.

Figure 3:
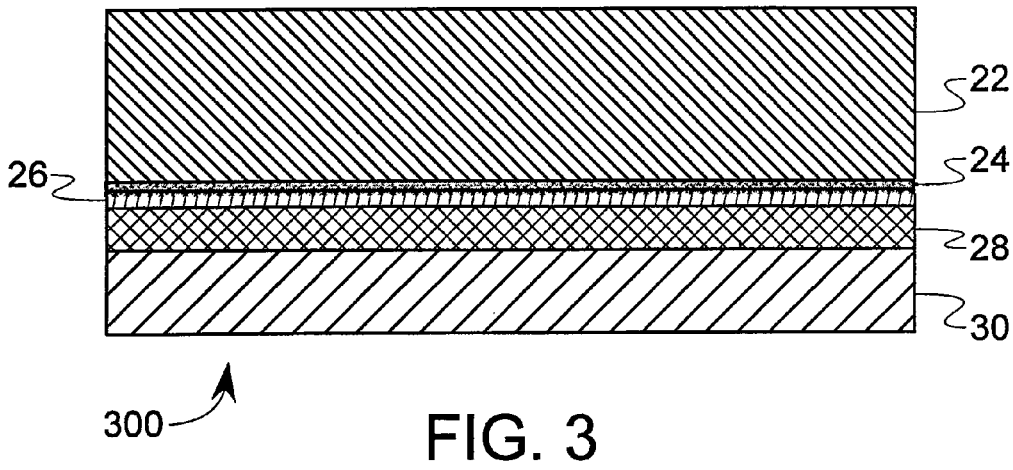
FIG. 3 is a cross-sectional view of a first multilayer embodiment of a fuser member of the present invention.
Figure 4:
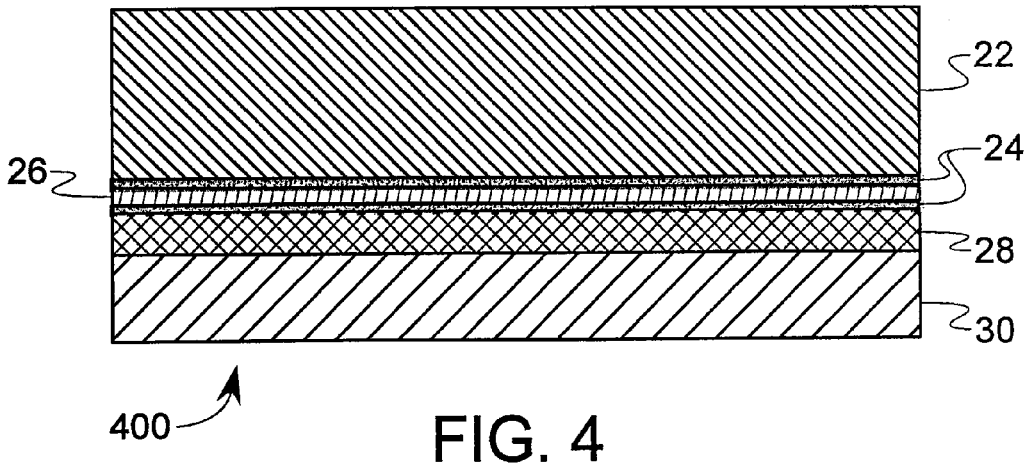
FIG. 4 is a cross-sectional view of a second multilayer embodiment of a fuser member of the present invention.
Figure 5:
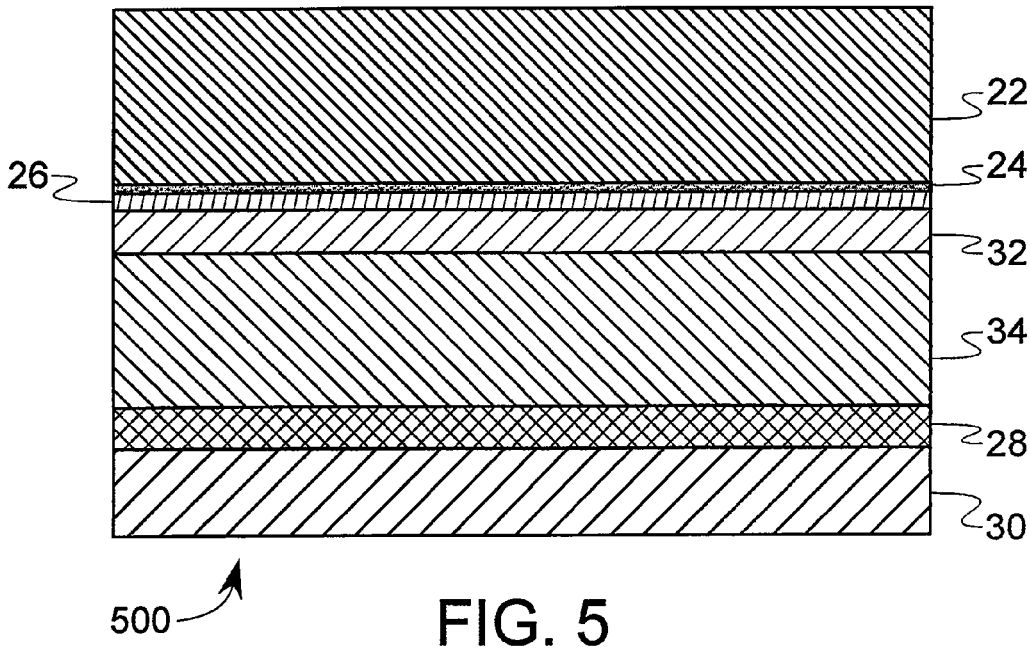
FIG. 5 is a cross-sectional view of a third multilayer embodiment of a fuser member of the present invention.

The fuser member may comprise numerous layer configurations and compositions FIGS. 3-5 illustrate 3 possible embodiments. The fuser member comprises a electrically conductive polymer layer 22, which includes a high tensile modulus substrate layer, such as a polyimide, polyamide-imide, or a polyetherimide polymer and combinations thereof. Other high temperature polymers are also contemplated as suitable materials. In a specific embodiment, the electrically conductive polymer layer 22 further includes an electrically conductive filler material, such as conductive carbon black. When using a polyimide in the electrically conductive polymer layer 22, the polyimide can be produced by a variety of processes known to one of ordinary skill in the art. A preferred polyimide may be obtained by casting a polyimide precursor onto the surface of a cylinder. A suitable polyimide precursor may be obtained by reacting an aromatic tetracarboxylic acid component with an aromatic diamine component in an organic polar solvent. The cast material is then thermally treated, and then subjected to a dehydration-condensation reaction to form polyimide. For instance, polyamic acid, a polyimide precursor, can be obtained by the polymerization of 3,3',4,4' biphenyltetracarboxylic dianhydride and p-phenylenediamine. To this polyamic acid, a conductive carbon black may be added in an amount sufficient to conduct heat produced from the current. Under one embodiment, 5 to 50% by weight of a carbon black is added. In a more specific embodiment, 5% to 20% of Printex XE2™, which is manufactured by Degussa, is added to the electrically conductive polymer layer 22. One of ordinary skill in the art will appreciate that additional polymers and/or filler may be employed to form the resistive layer. In one embodiment, the electrically conductive polymer layer 22 has a thickness of from about 10 to about 100 μm, with a sheet resistivity of from about 100 to about 1000 ohms/square. In addition, the electrically conductive polymer layer 22 may have a low thermal conductivity The electrically conductive polymer layer 22 provides numerous advantages in the fusing process. The electrically conductive polymer layer 22 is electrically conductive for a polymer, but is more resistive than the electrically conductive layer 26. These properties of the electrically conductive polymer layer 22 facilitate current flow through the resistive layer 24, which generates much of the fusing heat, and into the electrically conductive layer 26. The electrically conductive polymer layer 22 comprises a thin, smooth layer, which improves electrical contacts, and eases design considerations. Furthermore, the electrically conductive polymer layer 22 is a strong thermally resistant material able to withstand mechanical and thermal stresses.

The fuser member 300 also includes a resistive layer 24 adjacent to the electrically conductive polymer layer 22. The layer 24 creates a high resistance path for fusing heat generation. The resistive layer 24 is adjacent the electrically conductive layer 26, which serves as a primary conductive path for the current from the current supply element 4 to the current return element 6.

In one embodiment of the present invention, the resistive layer 24 comprises a suitable resistive material. The electrically conductive layer 26 may comprise a conductive metal material. The resistive layer 24 may comprise oxides or nitrides of aluminum, silicon, or boron, or any suitable thin resistive material that assists in binding to the electrically conductive layer 26. In one embodiment, the resistive layer 24 may comprise aluminum oxide and the electrically conductive layer 26 may comprise aluminum. An aluminum electrically conductive layer 26 may be formed from a vacuum deposition process; wherein the fuser member 300 is rotated in a vacuum deposition chamber while aluminum is deposited onto the surface of the fuser member 300. In one embodiment, the aluminum oxide layer 24 will typically be formed at the interface of the fuser member 300 and the aluminum layer 26. The formation of these layers may be accelerated with high humidity. As an alternative to aluminum oxide, the resistive layer 24 may also comprise silicon nitride or boron nitride. Similarly, the resistive layer 24 may have a thickness sufficient to provide effective binding and resistance. In one embodiment, the resistive layer 24 comprises an aluminum oxide material with has a thickness of 1 to 50 nm. The electrically conductive layer 26 comprises a material with a thickness sufficient to provide sufficient electrical conduction and thermal conductivity. In one embodiment, the electrically conductive layer 26 comprises a metal, such as aluminum, with a thickness of about 0.005 to about 0.2 μm and has a sheet resistivity of less than 10 ohms/square.

Adjacent to the electrically conductive layer 26, the fuser member 300 may also include a primer layer 28, which is used to improve binding between a release layer 30 and the electrically conductive layer 26. The primer layer 28, which typically has low thermal conductivity, comprises a material suitable for improving adhesion between the release layer 30, and the electrically conductive layer 26. In further embodiments, the primer layer 28 may be produced by spray coating an electrically conductive fluoropolymer primer such as Dupont type 855-023, or a non-electrically conductive ceramic reinforced primer such as type 857-101, which has good thermal conductivity. In accordance with a further embodiment, the primer layer 28 has a thickness of about 1 to about 5 μm.

The release layer 30, which is located on the outer surface of the fuser member 300, contacts the recording medium 50 as the recording medium passes the fusing nip area 8 and provides fusing heat to fuse toner images to the recording medium 50. Furthermore, the release layer 30 substantially reduces any tendency of the recording medium 50 and toner to adhere to the fuser member 300 as the recording medium 50 passes the fusing nip area 8. In one embodiment, the release layer 30 may comprise a polymer with high temperature stability, low surface energy material, such as a polytetrafluoroethylene or polyperfluoroalkoxy coating composition. This material assists in reducing the tendency of the recording medium 50 to adhere to the fuser member 300 during the fusing process. The release layer has a thickness sufficient to prevent the fuser member 300 from sticking to the recording medium 50. In further embodiments, the release layer 30 may comprise a polytetrafluoroethylene coating with a thickness of about 8 to about 30 μm, or a polytetrafluoroethylene sleeve with a thickness of about 20 to about 30 μm thick. The thickness is preferably as thin as possible to improve thermal response, but thick enough to maintain release for the life of the fuser member.

The release layer 30 may be produced by any suitable means known to one of ordinary skill in the art. Suitable methods may include spray coating a fluoropolymer, such as Dupont type 857-210 aqueous clear topcoat. A fluorosilicone may also be used in the release layer 30. In another embodiment, the release layer 30 has sufficient electrical conductivity to prevent accumulation of charge on the outer layer of the fuser member. In one embodiment, the resistivity may be greater than $1\times10^6$ ohm-cm to ensure that a current path from the electrically conductive layer 26 is not provided. The resistivity may combat the accumulation of charge, which may result in contamination of the recording medium 50 due to toner offset caused by undesirable electrostatic fields in and around the nip area 8.

FIG. 4 illustrates a further embodiment of a fuser member 400 according to the present invention, wherein an additional resistive layer 24 is placed between the electrically conductive layer 26 and the primer layer 28 to increase surface adhesion between these two layers.

In a further embodiment of the present invention as shown in FIG. 5, the fuser member 500 may also include a silicone layer 34 as shown in FIG. 5. This embodiment is preferable for color fuser members, due to the addition of the silicone layer 34. The silicone layer 34 is an elastomeric layer that functions as a flexible compliant layer. Color electrophotographic toner systems require better contact between the fusing member surface and the toner in order to obtain the color range needed by mixing the cyan, yellow, and magenta toners. Silicone is a suitable material because it can be very soft, it has adequate thermal stability, and it can be made relatively thermally conductive for a polymer. The silicone layer 34 may be situated between the primer layer 28 and the electrically conductive layer 26. In one embodiment, the silicone layer 34 comprises any thermally conductive silicone rubber having a thickness of about 100 to about 400 μm. This embodiment of the present invention may also include an additional primer layer 32 between the electrically conductive layer 26 and the silicone layer 34 to improve binding between these layers. The additional primer layer 40 may comprise an organosilane, or any other suitable binding polymer known to one of ordinary skill in the art.

In accordance with one embodiment of the present invention, the current supply element 4 and the current return element 6 may comprise electrodes in the form of rolls. The rolls may include an electrically conductive shaft comprised of a metal, ceramic, or a conductive polymer, wherein the electrically conductive shaft is connected to a power source. The shaft may also be coated with any suitable metal or electrically conductive polymer known to one of ordinary skill in the art. For example, the electrically conductive shaft may include a metal coating comprised of nickel, gold, or any other suitable electrically conductive metal material. In another embodiment, the electrically conductive shaft may include a coating of conductive polymer, for example conductive silicone foam. In a further embodiment, the silicone foam may also be coated with conductive filler, such as carbon black, or with a metallized coating.

Alternatively, the current supply element 4 and the current return element 6 may comprise solid rubber rolls, with electrically conductive coatings, such as carbon black, on their outer surface. In addition to rolls, the current supply element and the current return element may comprise brushes, plates, or other suitable embodiments. The current supply element 4 and the current return element 6 may each individually comprise rolls, brushes, plates and combinations thereof. The current supply element 4 and current return element 6 may also be located on separate portions of the same roll, brush, or plate. The current supply element 4 and the current return element 6 may comprise a metal brush, which is advantageous in exhibiting excellent temperature resistance, is relatively inexpensive, and has a low thermal mass. In another embodiment, the current supply element 4 and the current return element 6 may comprise a stationary tube or plate with electrically conductive fluoropolymer on the surface. A fluoropolymer coating or conductive fluoropolymer grease may be utilized to combat any frictional forces that may result.

While the fuser member embodiments described herein, for example in FIGS. 1 and 2, comprise rolls, one of ordinary skill in the art will recognize that fuser members comprising belts are equally within the scope of the present invention. Further, it is noted that terms like "generally", "specifically," "preferably," "typically", and "often" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A fuser member adapted to fuse toner on the surface of a recording medium passing a nip area of the fuser member, comprising:

an electrically conductive polymer layer;

a resistive layer;

an electrically conductive layer;

a primer layer;

a release layer; and a current supply element and a current return element, the current supply element and current return element being operable to provide current flow through the electrically conductive polymer layer and the resistive layer to generate fusing heat at the nip area.

2. A fuser member according to claim 1, wherein the current supply element and current return element are operable to provide current flow through the resistive layer and into the electrically conductive layer, and the electrically conductive layer is operable to provide the current to the current return element.

3. A fuser member according to claim 1 further comprising an additional resistive layer disposed between the electrically conductive layer and the primer layer.

4. A fuser member according to claim 1 wherein the oxide or nitride comprise aluminum, silicon, or boron.

5. A fuser member according to claim 1 wherein the resistive layer comprises a thickness of about 1 to about 50 nm.

6. A fuser member according to claim 1 wherein the electrically conductive polymer layer comprises polyimide, polyamideimide, or polyetherimide.

7. A fuser member according to claim 1 wherein the electrically conductive polymer layer comprises conductive filler.

8. A fuser member according to claim 7 wherein the conductive filler comprises carbon black.

9. A fuser member according to claim 1 wherein the electrically conductive polymer layer has a thickness of about 10 to about 100 μm.

10. A fuser member according to claim 1 wherein the electrically conductive layer comprises metal.

11. A fuser member according to claim 1 wherein the electrically conductive layer has a thickness of about 0.05 to about 0.20 μm thick.

12. A fuser member according to claim 1 wherein the primer layer comprises fluoropolymer.

13. A fuser member according to claim 1 wherein the primer layer has a thickness of about 1 to about 5 μm.

14. A fuser member according to claim 1 wherein the release layer comprises fluoropolymer.

15. A fuser member according to claim 1 wherein the release layer has a thickness of about 8 to about 30 μm.

16. A fuser member according to claim 1 further comprising a thermally conductive silicone layer disposed between the electrically conductive layer and the primer layer.

17. A fuser member according to claim 16 wherein the silicone layer has a thickness of about 100 to about 400 μm.

18. A fuser member according to claim 16 further comprising an additional primer layer disposed between the thermally conductive silicone layer and the electrically conductive layer.

19. A fuser member according to claim 18 wherein the additional primer layer comprises organosilane.

20. A fuser member according to claim 1 wherein the electrically conductive polymer layer is a continuous layer.

21. A fuser member according to claim 1 wherein the resistive layer comprises an oxide or nitride.

22. A fuser member according to claim 1 wherein the primer layer is disposed between the electrically conductive layer and the release layer.

23. A fuser member adapted to fuse toner on the surface of a recording medium passing a nip area of the fuser member comprising:

an electrically conductive polymer layer;

a resistive layer;

an electrically conductive layer;

a primer layer;

a release layer; and a current supply roll and a current return roll, the current supply roll and current return roll being operable to provide current flow through the electrically conductive polymer layer and the resistive layer to generate fusing heat at the nip area.

24. A fuser member according to claim 23 wherein the electrically conductive polymer layer is a continuous layer.

* * * * *